US005078125A

United States Patent [19]

Schumacher

[11] Patent Number: 5,078,125

[45] Date of Patent: Jan. 7, 1992

[54] BACK MASSAGING APPARATUS

[76] Inventor: Jerry H. Schumacher, 141 West Randall Rd., Carroll, Iowa 51401

[21] Appl. No.: 479,268

[22] Filed: Feb. 13, 1990

[51] Int. Cl.[5] ..... A61H 7/00

[52] U.S. Cl. ..... 128/52; 128/33; 128/62 R

[58] Field of Search ..... 128/24.1, 24.5, 800, 128/801, 52, 51, 33, 62 R

[56] References Cited

U.S. PATENT DOCUMENTS

| | | | |
|---|---|---|---|
| 41,835 | 3/1864 | Drummond . | |
| 1,977,188 | 10/1934 | Kunz . | |
| 2,461,102 | 2/1949 | Ackerman . | |
| 3,078,843 | 2/1963 | Brisson | 128/52 |
| 3,389,699 | 6/1968 | Mathers | 128/33 |
| 3,405,709 | 10/1968 | Mathers | 128/33 |
| 3,671,357 | 6/1972 | Ferguson . | |
| 4,041,938 | 8/1977 | Wintoniw | 128/52 |
| 4,721,100 | 1/1988 | Hengl | 128/52 |

*Primary Examiner*—Robert A. Hafer
*Assistant Examiner*—David J. Kenealy
*Attorney, Agent, or Firm*—Henderson & Sturm

[57] ABSTRACT

An apparatus for massaging a person's back of a type including a housing adapted to be positioned beside and above a bed. A back contacting portion is provided for rubbing the back of a person lying on the bed and a reciprocation mechanism is operatively attached to the housing for automatically moving the back contacting structure back and forth over a person's back. The reciprocating structure includes a frame with an endless flexible member thereon, such as a chain. the endless flexible member is joined at both ends thereof to allow it to move in an elliptical path. A cog is attached to the endless flexible member so that when the endless flexible member is driven, the cog will also travel in such elliptical path. A reciprocating member is disposed around the frame and has a first cog engagement portion in one side thereof for engagement with the cog when the cog is moving in one linear direction whereby the reciprocating member will be moved in such one linear direction when the cog is so moving. A second cog engagement portion is provided on the opposite side of the reciprocating member for engagement with the cog when the cog is moving in the second linear direction, opposite the first linear direction, whereby the reciprocating member will be moved in the second linear direction when the cog is moving in such second linear direction.

13 Claims, 4 Drawing Sheets

BACK MASSAGING APPARATUS

TECHNICAL FIELD

The present invention relates generally to a back massager and more particularly to a back massager with a novel reciprocating mechanism forming a part thereof.

BACKGROUND ART

Various back massaging devices have been patented over the years such as U.S. Pat. Nos. 2,461,102 to Ackerman patented in 1949, 3,078,843 to Brisson patented in 1963, 3,672,357 to Ferguson patented in 1972, 4,041,938 to Wintoniw patented in 1977 and 4,721,100 to Hengl patented in 1988.

While there has been considerable interest and development in the back massaging art, the devices which have been developed over the years still tend to be unduly complicated, expensive to build and take up too much space for the ordinary home user of such a device.

Consequently there is a need for a back massaging device which is more economical to build and which is more compact.

DISCLOSURE OF THE INVENTION

The present invention relates to an apparatus for massaging a person's back of a type including a housing adapted to be positioned beside and above a bed. A back contacting portion is provided for rubbing the back of a person lying on the bed and a reciprocation mechanism is operatively attached to the housing for automatically moving the back contacting structure back and forth over a person's back. The reciprocating structure includes a frame with an endless flexible member thereon, such as a chain. The endless flexible member is joined at both ends thereof to allow it to move in an elliptical path. A cog is attached to the endless flexible member so that when the endless flexible member is driven, the cog will also travel in such elliptical path.

A reciprocating member is disposed around the frame and has a first cog engagement portion in one side thereof for engagement with the cog when the cog is moving in one linear direction whereby the reciprocating member will be moved in such one linear direction when the cog is so moving. A second cog engagement portion is provided on the opposite side of the reciprocating member for engagement with the cog when the cog is moving in the second linear direction, opposite the first linear direction, whereby the reciprocating member will be moved in the second linear direction when the cog is moving in such second linear direction.

An object of the present invention is to provide an improved back massaging apparatus.

Another object of the present invention is to provide a back massaging apparatus which is cheaper to build than prior art devices of a similar nature.

A still further object of the present invention is to provide a back massaging apparatus which is more compact than prior art back massaging devices heretofore available.

Other objects, advantages, and novel features of the present invention will become apparent from the following detailed description of the invention when considered in conjunction with the accompanying drawings.

BEST MODE FOR CARRYING OUT THE INVENTION

Figure 1:
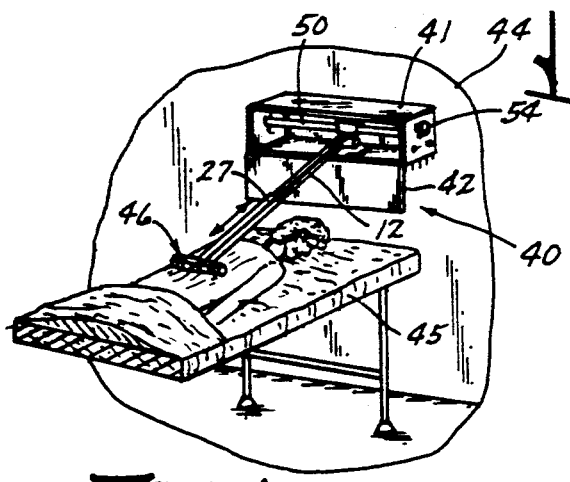
FIG. 1 is a perspective view of a preferred embodiment of the present invention with a portion of a bed broken away for illustrative purposes.

Referring now to the drawings wherein like reference numerals designate identical or corresponding parts throughout the several views, FIG. 1 shows a back massaging apparatus (40) constructed in accordance with the present invention.

Figure 2:
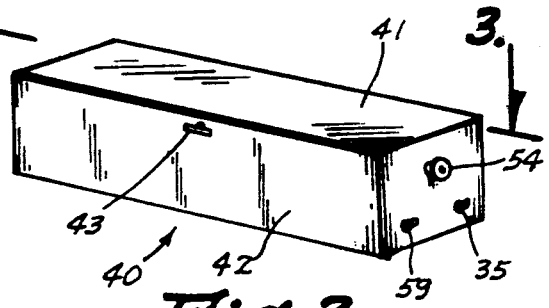
FIG. 2 is a perspective view of the housing of the preferred embodiment with the device folded inside thereof.
Figure 3:
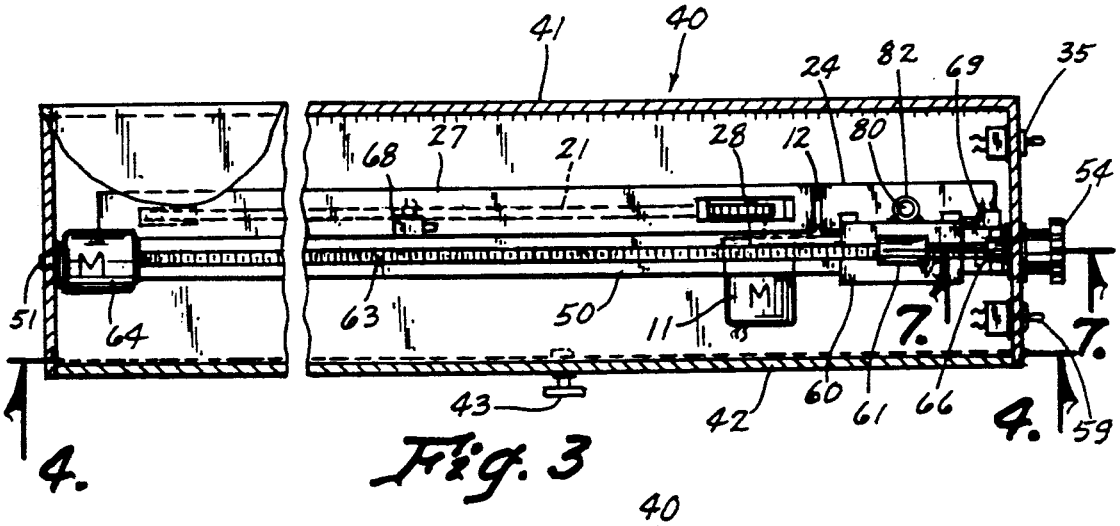
FIG. 3 is a cross sectional view taken along line 3—3 of FIG. 2.

The back massaging apparatus (40) includes a housing (41) having a front door (42) which can be opened by a latch (43) to allow it to move between the position shown in FIG. 2 and the position shown in FIG. 1.

The apparatus (10) can be connected to a wall (44) or the like and a bed (45) can be positioned adjacent thereto for example as shown in FIG. 1.

When the apparatus (40) is moved to the position shown in FIG. 1, a switch (35) can be actuated to turn on a rotary electric motor (11) which will cause reciprocating member (27) to reciprocate the back contacting portion (46) back and forth over the person's back as is shown in FIG. 1. The apparatus (10), shown most clearly in FIG. 9–14, converts the rotary motion of the motor (11) to reciprocating motion.

Figure 10:
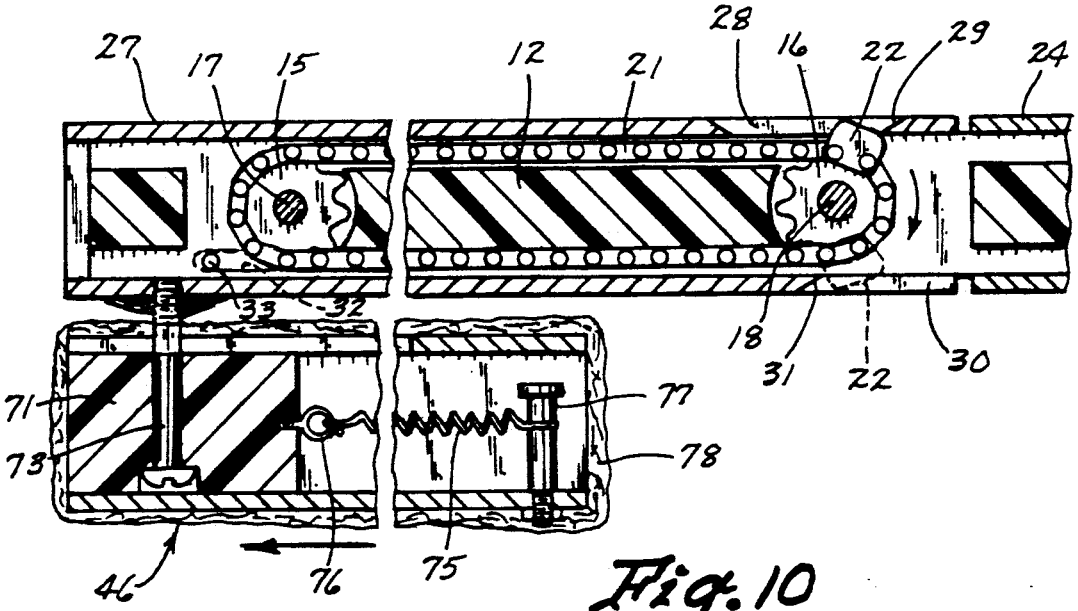
FIG. 10 is a cross sectional view taken along line 10—10 of FIG. 9.
Figure 11:
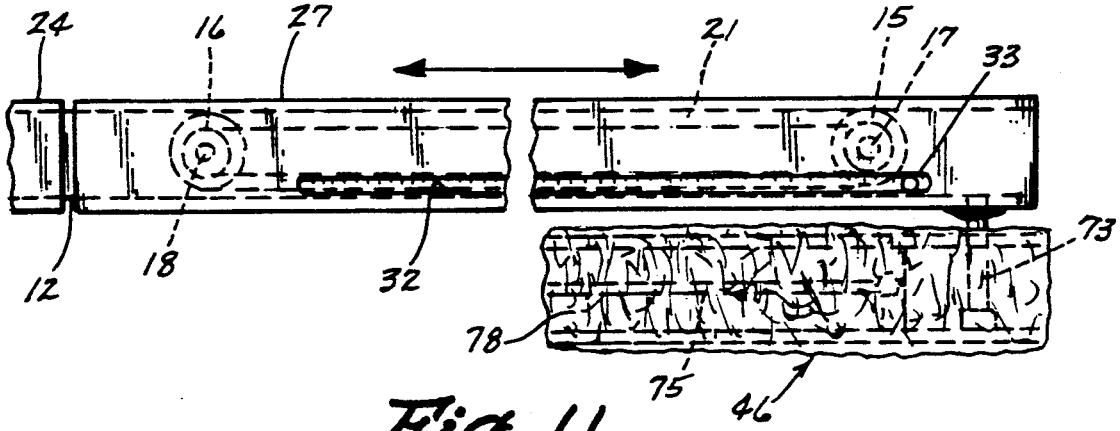
FIG. 11 is a view taken along line 11—11 of FIG. 9.
Figure 12:
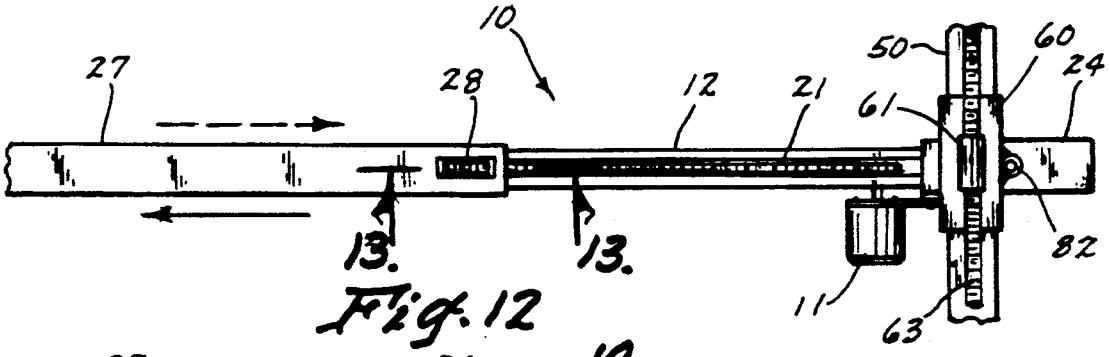
FIG. 12 is a top elevational view of the apparatus which converts rotary action to reciprocating action and showing in solid lines an arrow indicating extension of the reciprocating device and in dashed lines is an arrow indicating the direction of movement when the reciprocating device is retracting.
Figure 13:
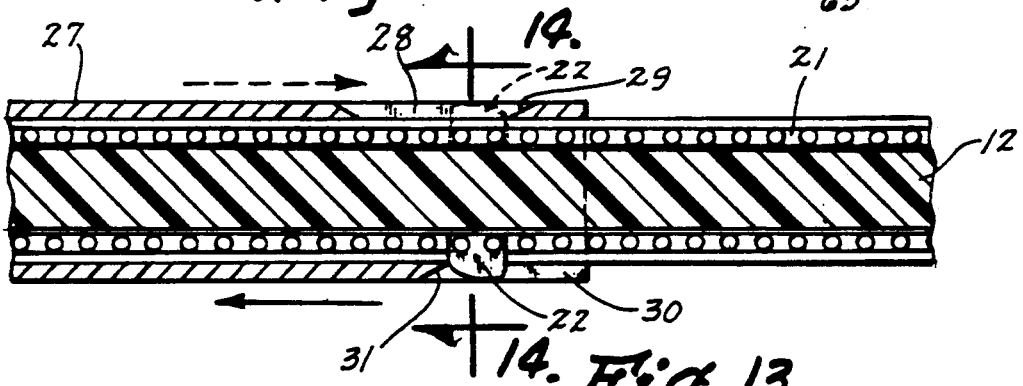
FIG. 13 is an enlarged cross sectional view taken along line 13—13 of FIG. 12.
Figure 14:
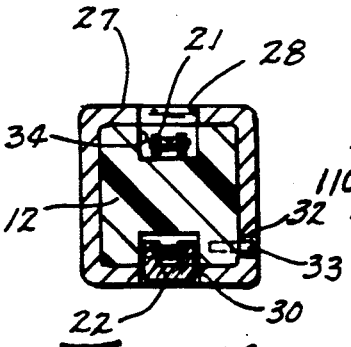
FIG. 14 is an enlarged cross sectional view taken along line 14—14 of FIG. 13.

Referring to FIGS. 9–14, it will be noted that when the switch (35) is turned on and the motor (11) actuated, a sprocket (18) will be turned because the motor (11) turns the drive shaft (18). This will cause the chain (21)

to be rotated around the sprocket (16) and around the sprocket (15). This, in turn, causes the cog (22) to move in an elliptical path so that when it is on the top part of the elliptical path as shown in FIG. 10 in solid lines and FIG. 13 in dashed lines, it will contact portion (29) of the reciprocating member (27) and cause the reciprocating member (27) to move to the right as viewed in FIG. 13 in the direction of the dashed arrow; When the cog (22) is moving on the lower portion of the elliptical path, it will contact portion (31) of slot (30) of the reciprocating member (27) and cause the reciprocating member (27) to move in an opposite linear direction, specifically in the direction shown by the solid arrow when viewed in FIG. 13. If the motor (11) is left on, the reciprocating member (27) will continue to alternatively extend when the cog (22) is contacting the contact portion (31) of slot (30) and will continue to retract so long as the cog (22) is in contact with the contact portion (29) of slot (26). A slot (32) in reciprocating member (27) and a pin (33) in frame (12) will prevent the reciprocating member (27) from falling off of the frame (12).

Figure 4:
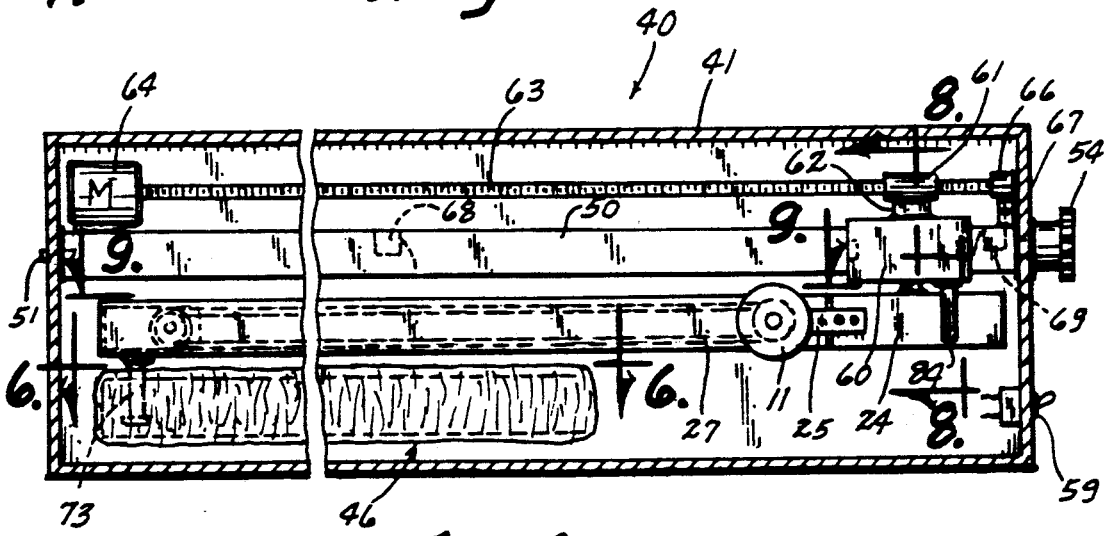
FIG. 4 is a cross sectional view taken along line 4—4 of FIG. 3.

In general, the remainder of the structure of the back massaging apparatus (40) besides reciprocation apparatus (10) is provided for moving the reciprocating apparatus and the back contacting member (46) between the position shown in FIG. 4 and the position shown in FIG. 1.

Figure 7:
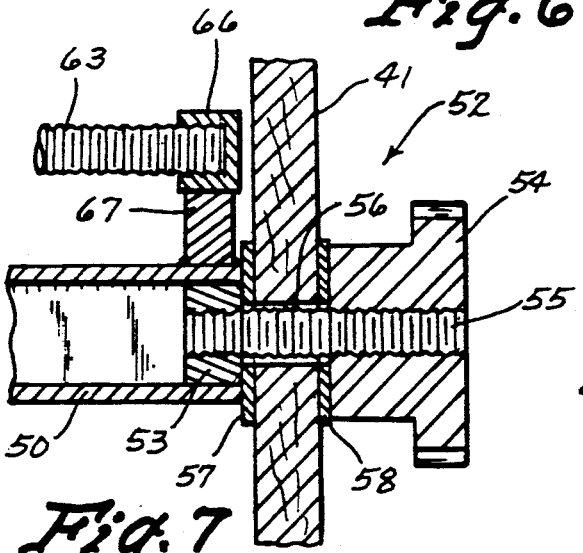
FIG. 7 is an enlarged cross sectional view taken along line 7—7 of FIG. 4.

A shaft (50) is pivotally mounted to the housing (41) on one end by a pin (51) and on the other end by the frictional braking apparatus (52) shown in FIG. 7.

The frictional braking apparatus (52) has a square nut (53) welded inside the tubular shaft (50) and the nut (53) is internally threaded. A handle (54) is rigidly attached to a threaded post (55) and the handle (54) and (55) move in unison with each other. An opening (56) through the housing (41) is provided and has frictional washers (57) and (58) on each side of the housing (41) so that when the handle (54) is used to tightly pull the nut (53) against the washer (57), this will cause a braking action against the tubular shaft (50) so that it cannot easily be pivoted about its pivotal axis. This is used to hold the frame (12) and reciprocating member (27) and contact member (46) upwardly above the person on the bed (45) so that it will not drop down too far. Alternatively, the braking handle (54) can be loosened to allow the frame (12), reciprocating member (27) and contact portion (46) to pivot easily downwardly or the braking mechanism (52) can be utilized to cause a limited amount of pivoting with a predetermined amount of resistance to pivoting, all of which is adjustable by the operator of the back massaging apparatus (40) by using braking handle (54).

Figure 8:
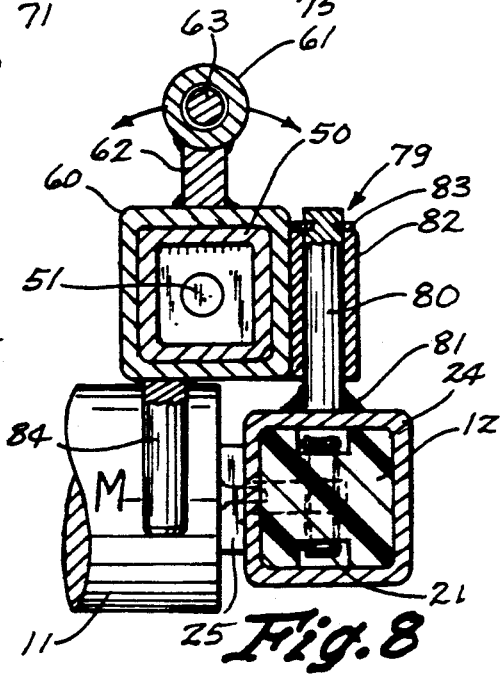
FIG. 8 is an enlarged cross sectional view taken along line 8—8 of FIG. 4.
Figure 9:
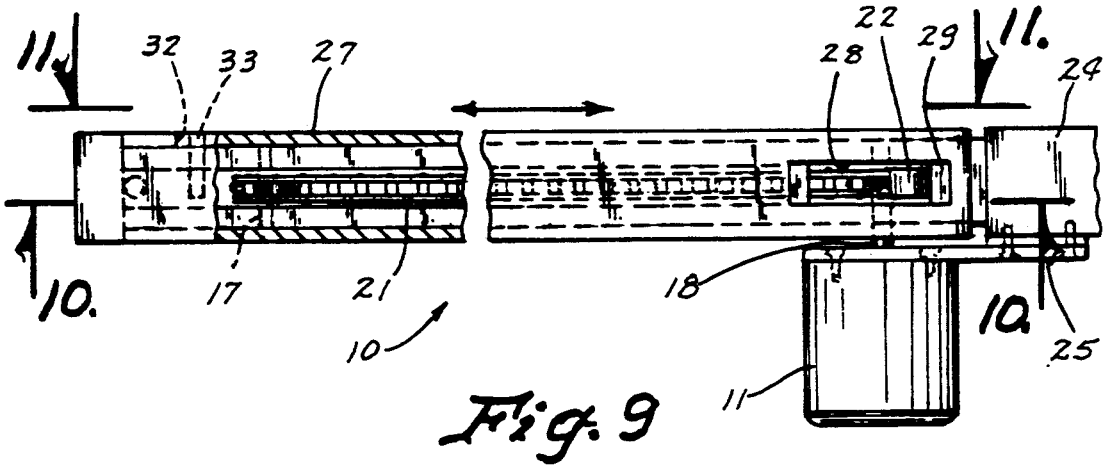
FIG. 9 is an enlarged cross sectional view taken along line 9—9 of FIG. 4.

A slide member (60) which is shown in FIGS. 4 and 8 is freely slidable on the shaft (50) except that its position on the shaft (50) is determined by the position of internally threaded member (61) which is welded to the slide member (60) by bracket (62).

A threaded rod (63) extends through internally threaded member (61) and engages it. The threaded rod (63) is rotatably attached to the output shaft of a motor (64) and the threaded rod (63) is rotatably journaled in a bearing member (66) at the other end thereof as is clearly shown in FIGS. 4 and 7. The bearing member (66) is rigidly attached to the shaft (50) by bracket (67), which is welded to the bearing (66) at the top and to the shaft (50) at the bottom thereof.

The back contacting portion (46) includes a metal tubular member (70) having a slide member (71) slidable therein. This metal tubular member (70) has a first slot (72) for permitting connector shaft (73) to slide therein and to pivot therein and a second slot portion (74) which will allow the connector member (72) to slide therein but will prevent rotation of the member (73) therein because of the close tolerances between the slots (74) and the member (73).

Figure 6:
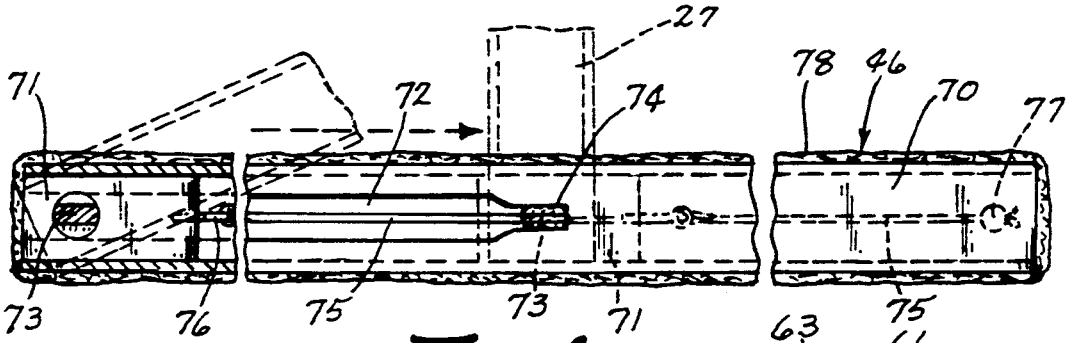
FIG. 6 is a cross sectional view taken along line 6—6 of FIG. 4 and showing in dashed lines an intermediate position during the folding process and a final position for use.

Member (73) is rotatably attached to the slide member (71) so that the reciprocating member (27) can pivot with respect to the slide member (71) when the connector member (73) is in the wider slot (72), but when the connector member (73) is in the narrow portion of the slot (74), as is shown in FIG. 6, the connector member (27) cannot pivot with respect to the metal tube (70) because the connector member (73) is rigidly attached to the reciprocating member (27).

The slide member (71) has an elastic member (75) connected thereto by an eyelet (76). The other end of the elastic member (75) is connected to a pin (77) in the other end of the tube (70) so that when the tube (70) is pivoted so that it is perpendicular to the reciprocating member (27), for example as shown in dashed lines in FIG. 6, the elastic member (75) will pull the member (71) and connector member (73) from the position shown in solid lines in FIG. 6 to the position shown in dashed lines in FIG. 6 wherein the connector member (73) will be held securely in the narrow slot (74) which, as mentioned above, prevents the metal tube (70) from rotating with respect to the reciprocating member (27) and vice versa.

A cloth covering (78) extends around the metal tube (70) to soften the contact between the metal tube (70) and the person whose back is being massaged. Other padding structures can be used instead of cloth covering (78).

In operation, in order to utilize the apparatus (40), as shown in FIG. 2, the latch (43) would be released and the door (42) is allowed to drop down as is shown in FIG. 1. At that time, the user would reach in and grasp reciprocating member (27) and pull it slightly towards the position shown in FIG. 5 to prevent the motor (64) from pushing the left end of the reciprocating member (27) directly against the left edge of the housing (41). As long as the left of the reciprocating member (27) is outside of the housing (41), then the switch (59) can be actuated in a forward direction which will cause rotation of threaded member (63) in one rotary direction which will thereby cause the internally threaded member (61) and thereby everything rigidly connected to it to move to the left as is shown in FIG. 5, until the slide member (60) contacts forward limit switch (68), at which time the motor (64) will be turned off.

At that time, the reciprocating member (27) can be grasped and pivoted to the right because of the hinge (79) which pivotally attaches member (24) and frame (12) to the slide member (60). The hinge (79) includes a pin (80) which is welded by weld (81) to the member (24) and this pin (80) extends through a tube (82) which is welded to the slide (60). A metal clip (83) is provided for preventing the pin (80) from sliding out of the tube (82). The tube (82) is, of course, welded to the slide member (60) as can best be seen in FIG. 8.

Figure 5:
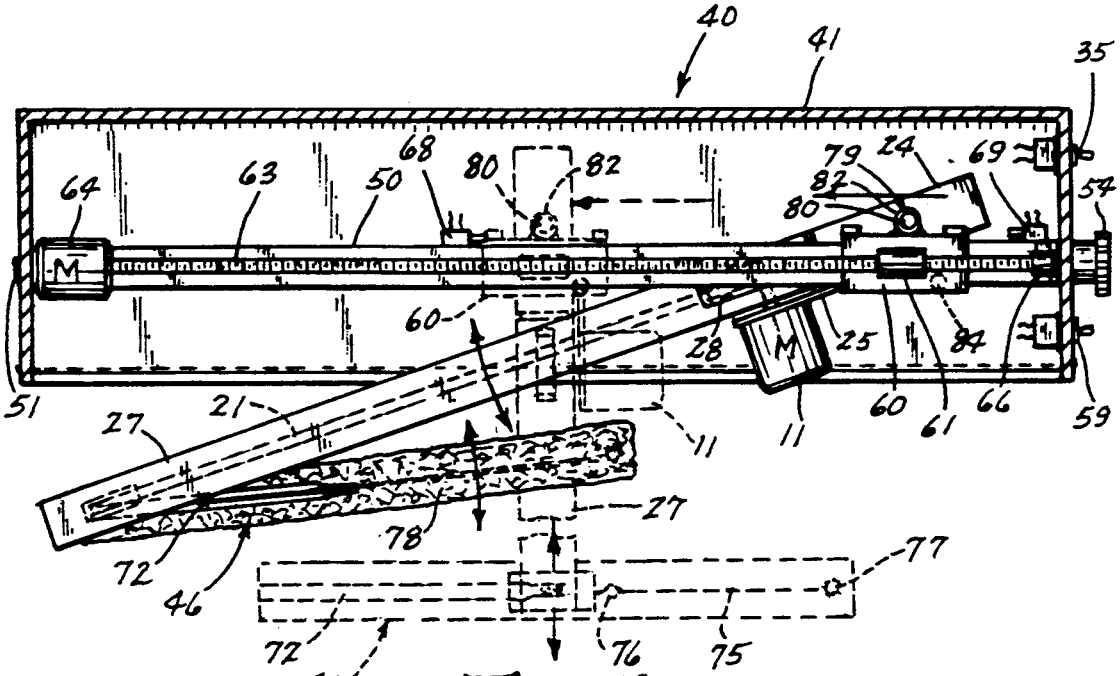
FIG. 5 is a view like FIG. 3 but showing the initial stages of unfolding of the present invention in solid lines and illustrating its operative position in dashed lines.

A stop member (84) is also welded to the bottom of the slide (60) so that when the reciprocating member (27) is pivoted from the position shown in solid lines in FIG. 5 to the position shown in dashed lines in FIG. 5 that the stop member (84) will prevent the frame (12) and slide member (27) from pivoting too far in a counterclockwise direction as viewed in FIG. 5.

The back contacting portion (46) would then be positioned above the bed (45) by using the brake handle (54) to hold it in such position, the user would then lie on the bed (45), as is shown in FIG. 1, and the brake handle (54) could be released to whatever extent is desired to allow the back contact portion (46) to pivot downwardly against the user's back as is shown in FIG. 1.

The switch (35) can then be turned on to cause the motor (11) to operate constantly, which will cause the reciprocating mechanism (10) to constantly move the contact bar (46) up and down along the user's back to perform the back massaging function, which is of course the goal of this invention. When the user has used the back massaging apparatus (40) to the extent desired, the switch (35) is turned off to stop the reciprocating action of the contact bar (46). The contact portion (46) would be lifted slightly so that frame (12) and (27) would be pivoted upwardly about the axis of the shaft (50) and then the friction brake (52) would be tightened down by handle (54) to keep the contact portion (46) in the raised position thereof.

Figure 15:
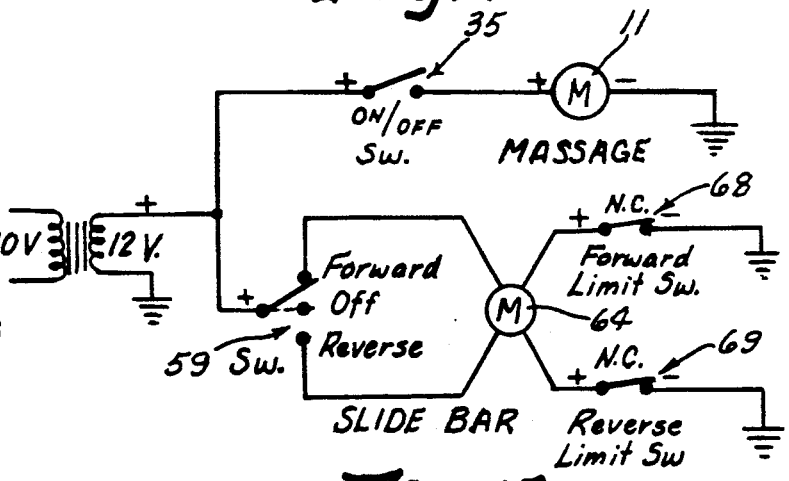
FIG. 15 is a schematic view of the electrical operating system for the preferred embodiment disclosed herein.

The switch (59) could then be turned to the reverse position thereof, as is shown in FIG. 15, and the threaded rod (63) will be turned in the opposite direction to the direction mentioned above and this will cause the internally threaded member and everything connected thereto to move to the right as is shown in FIG. 5 until such time that the slide member (60) contacts the reverse limit switch (69), at which time the electricity will be cut off to the motor (64). The back contacting portion (46) can then again be folded by pulling the bar (70) to the right as viewed in FIG. 6, until the connector (73) moves out of the narrow slot (74), at which time the tube (70) can be folded towards the position shown in FIGS. 4 and 5. Then the frame (12), reciprocating member (26) and contact portion (46) can be pushed into the housing (41) to the position shown in FIG. 4 wherein the structure will generally be pivoted about the hinge (79). The door (42) can then be closed and latched shut until its next use.

Accordingly, it will be appreciated that the preferred embodiment disclosed above does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. In an apparatus for massaging a person's back of a type including a housing adapted to be positioned beside and above a bed, contact means for rubbing the back of a person lying on a bed and reciprocation means operatively attached to said housing for automatically moving said contact means back and forth over a person's back, said reciprocating means comprising:

a frame;

an endless flexible member;

first means for journaling one end of said endless flexible member to said frame about a first axis for permitting said endless flexible member to move in one rotary direction therearound;

second means for journaling the opposite end of said endless flexible member to said frame about a second axis;

a cog attached to said endless flexible member;

driving means for causing said endless flexible member to move in said one rotary direction whereby said cog will move in an elliptical path about said first and second axes;

a reciprocating member disposed around said frame;

first cog engagement means in one side of said reciprocating member for engagement with said cog when said cog is moving in one linear direction whereby said reciprocating member will be moved in said one linear direction when said cog is moving in said one linear direction;

second cog engagement means on the opposite side of said reciprocating member for engagement with said cog when said cog is moving in a second linear direction, opposite to said first linear direction, whereby said reciprocating member will be move din said second linear direction when said cog is moving in said second linear direction;

a shaft connected to said housing;

slide means attached to said shaft for sliding movement along said shaft;

means for pivotally attaching one end of said slide means to said frame along a first pivotal axis; and means for pivotally attaching said contact means to said reciprocating member along a second pivotal axis to permit said contact means to rotate at least ninety degrees with respect to said reciprocating member between a first position substantially parallel to said reciprocating member and a second position substantially perpendicular to said reciprocating member.

2. The apparatus of claim 1 wherein said endless flexible member is a chain.

3. The apparatus of claim 2 wherein said first journaling means comprises a first sprocket rotatably attached to said frame about said first axis.

4. The apparatus of claim 3 wherein said second journaling means comprises a second sprocket rotatably attached to said frame about said second axis.

5. The apparatus of claim 1 wherein said first cog engagement means includes a slot in said reciprocating member for receiving said cog therein.

6. The apparatus of claim 1 wherein said frame is an elongated member and said reciprocating member is an elongated sleeve telescopically received over said frame.

7. The apparatus of claim 1 wherein said driving means comprises an electric motor.

8. The apparatus of claim 1 including means for selectively holding said contact means in said second position during operation of said reciprocating means.

9. The apparatus of claim 1 including means for automatically moving said slide means between a first position on said shaft and a second position on said shaft.

10. The apparatus of claim 9 wherein said moving means comprises:

a threaded rod;

a threaded member attached to said slide means and threadably engaging and surrounding said threaded rod; and means for selectively rotating said threaded rod whereby said slid means can be moved between said first and second positions thereof depending upon the direction and duration of rotation of said threaded rod.

11. The apparatus of claim 10 wherein said rotating means comprises a reversible electric motor.

12. In an apparatus for massaging a person's back of a type including a housing adapted to be position beside and above a bed, contact means for rubbing the back of a person lying on a bed and reciprocation means operatively attached to said housing for automatically moving said contact means back and forth over a person's back, said reciprocating means comprising:

a frame;

an endless flexible member;

first means for journaling one end of said endless flexible member to said frame about a first axis for permitting said endless flexible member to move in one rotary direction therearound;

second means for journaling the opposite end of said endless flexible member to said frame about a second axis;

a cog attached to said endless flexible member;

driving means for causing said endless flexible member to move in said one rotary direction whereby said cog will move in an elliptical path about said first and second axes;

a reciprocating member disposed around said frame;

first cog engagement means in one side of said reciprocating member for engagement with said cog when said cog is moving in one linear direction whereby said reciprocating member will be moved in said one linear direction when said cog is moving in said one linear direction;

second cog engagement means on the opposite side of said reciprocating member for engagement with said cog when said cog is moving in a second linear direction, opposite to said first linear direction, whereby said reciprocating member will be moved in said second linear direction when said cog is moving in said second linear direction;

a shaft connected to said housing;

slide means attached to said shaft for sliding movement along said shaft;

means for pivotally attaching one end of said slide means to said frame along a first pivotal axis; and means for pivotally attaching said shaft to said housing along a third pivotal axis whereby said frame, reciprocating member and contact means can pivot up or down about said third pivotal axis.

13. The apparatus of claim 12 including frictional braking means attached to said housing and to said shaft for selectively either locking said frame, reciprocating member and contact means in a position raised above a person lying on the bed or releasing said shaft to allow said contact means to move between said raised position and a lowered position in contact with the back of a person disposed on the bed.

* * * * *